United States Patent [19]

De Obaldia B.

[11] Patent Number: 4,535,554

[45] Date of Patent: Aug. 20, 1985

[54] MOLDED FOOTWEAR

[76] Inventor: Marcos G. De Obaldia B., P.O. Box 9-089, Panama 9, Panama

[21] Appl. No.: 524,061

[22] Filed: Aug. 17, 1983

[30] Foreign Application Priority Data

Jan. 25, 1983 [PA] Panama ..... 032057

[51] Int. Cl.[3] ..... A43B 5/1

[52] U.S. Cl. ..... 36/113; 36/129; 36/11.5; 36/87; 36/102

[58] Field of Search ..... 36/11.5, 58.5, 87, 83, 36/84, 129, 113, 114, 102

[56] References Cited

U.S. PATENT DOCUMENTS

| | | | |
|---|---|---|---|
| 876,091 | 1/1908 | Reed | 36/58.5 |
| 900,881 | 10/1908 | Parker | 36/11.5 X |
| 1,012,245 | 12/1911 | Chase | 36/11.5 |
| 1,386,684 | 8/1921 | Bradford | 36/11.5 |
| 1,690,690 | 11/1928 | Miller | 36/58.5 |
| 1,769,328 | 7/1930 | Auster | 36/11.5 |
| 1,773,127 | 8/1930 | Auster | 36/11.5 |
| 1,803,554 | 5/1931 | Knilans | 36/83 X |
| 4,107,857 | 8/1978 | Devlin | 36/129 |
| 4,124,946 | 11/1978 | Tomlin | 36/11.5 X |
| 4,132,016 | 1/1979 | Vaccari | 36/114 |
| 4,294,023 | 10/1981 | Banford | 36/11.5 |

FOREIGN PATENT DOCUMENTS

| | | | |
|---|---|---|---|
| 1037244 | 4/1953 | France | 36/11.5 |
| 2484215 | 12/1981 | France | 36/87 |
| 347406 | 4/1937 | Italy | 36/11.5 |

*Primary Examiner*—Werner H. Schroeder
*Assistant Examiner*—Tracy-Gene Graveline
*Attorney, Agent, or Firm*—Beveridge, DeGrandi and Weilacher

[57] ABSTRACT

An article of footwear is formed of a molded plastic body member, a molded plastic foot support member which supports the wearer's foot, and a flexible harness which retains the body member on the wearer's foot. The body member has a sole portion, a toe cup, a heel cup, and longitudinal sidewalls which extend from the toe cup to the heel cup. The foot support member has an upper surface, located at about the same height as the upper edges of the sidewalls, which provides anatomical support for a wearer's foot. The harness has a horizontal strap and inclined straps. The horizontal strap is connected to the heel cup, and the inclined straps are connected to the sidewalls of the body member.

13 Claims, 8 Drawing Figures

MOLDED FOOTWEAR

BACKGROUND OF THE INVENTION

This invention relates to an article of footwear which is comfortable, lightweight, well-ventilated, and easily manufactured and assembled in large quantities.

Preferably, the invention is used as a jogging sandal. Present sportshoes and running shoes have a relatively complicated structure which requires the use of many manufacturing and assembly steps. Further, they often are relatively heavy and they invariably have limited ventilation because they cover most of the foot. Existing sandals, clogs, thongs and casual footwear, although often being well-ventilated, are not suitable for jogging because they do not provide adequate anatomical support and shock absorption.

Some objects of this invention are to provide an article of footwear which is lightweight and well-ventilated, while also providing good traction, anatomical support and shock absorption.

Other objects are to provide an article of footwear which has an uncomplicated construction suitable for inexpensive manufacture in large quantities and in different styles, designs, sizes and colors.

Further objects are to provide footwear articles which are easy to put on, easy to wash, and which permit flexibility of the foot joints.

SUMMARY OF THE INVENTION

According to the invention, an article of footwear is formed of three main components; namely, a flexible integrally molded body member which has a sole portion, a flexible molded foot support member mounted on the body member where it overlies the sole portion, and a flexible harness member connected to the body member for retaining the body member on the foot of the wearer. The foot support member has an upper surface which is configured to correspond to and provide anatomical support for a wearer's foot. Preferably, but not essentially, the invention also includes one or more of the structural features described below.

The article of footwear is open from the toe cup to the harness to expose a wearer's foot. The body member is provided with a forward toe cup, longitudinal sidewalls located on opposite sides of the foot support member, and a rear portion which has a heel cup and a forwardly open pocket. The upper edges of the sidewalls are at about the same height as the upper surface of the foot support member. The heel cup includes forwardly extending side flaps, and the sidewalls have upwardly extending tab portions. The straps of the harness member may be connected to these side flaps and tabs.

The foot support member may have its upper surface provided with a toe recess, a recess for accommodating a ball of a wearer's foot, a recess for accommodating the heel of a wearer's foot, and a raised arch support portion. The rear end of the foot support member is retained in the forwardly open pocket of the body member.

The harness member preferably has generally horizontal straps and inclined straps, the latter being inclined downwardly and rearwardly. The horizontal straps are connected to the heel cup and the inclined straps are connected to the sidewalls.

DESCRIPTION OF THE PREFERRED EMBODIMENT

Figure 1:
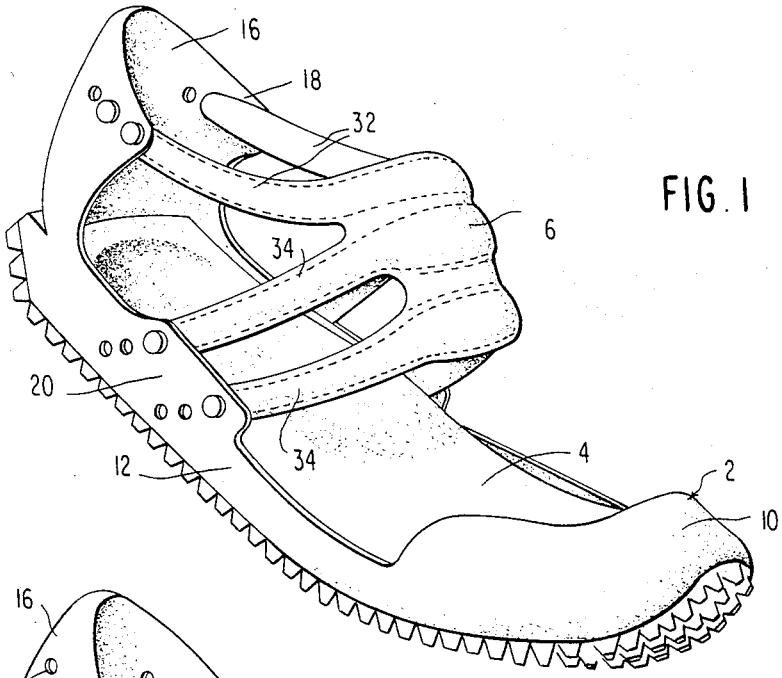
FIG. 1 is a perspective view of an article of footwear constructed according to the invention.

Articles of footwear constructed according to the invention may be used for various purposes, but preferably it is a jogging sandal which is shown in FIG. 1. It is formed of three principal components, each of which is a unitary, integrally-molded piece of plastic material such as natural rubber, synthetic rubber or an elastomeric polymer. These components are the body member 2, the anatomical foot support 4 and the harness member 6. In normal use, these components are connected together as shown in FIG. 1.

Figure 2:
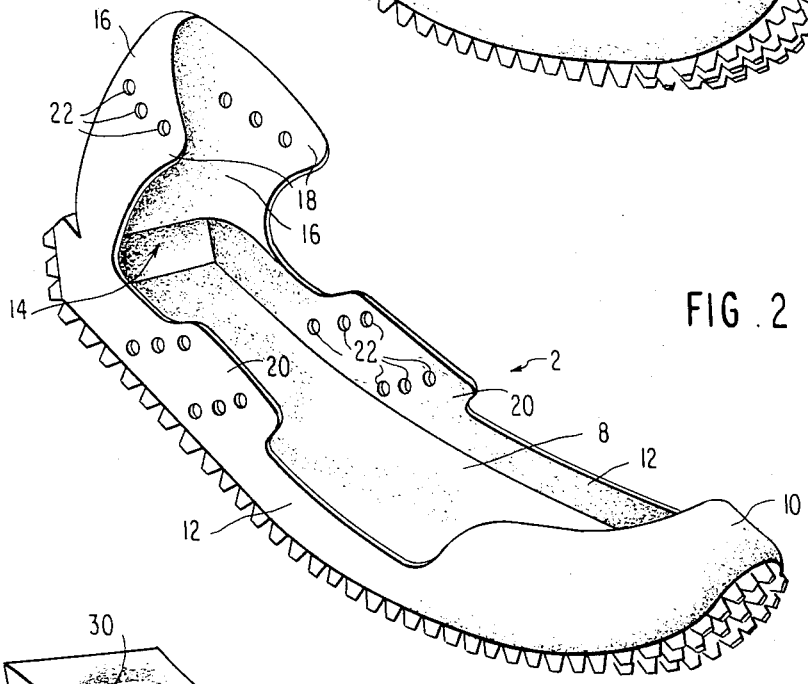
FIG. 2 is a perspective view of the body member of the article of footwear.

As best shown in FIG. 2, the body member 2 is a single piece of molded plastic material which has a sole portion 8, a toe cup 10, longitudinal sidewalls 12, and a rear portion which has a forwardly open pocket 14 and a heel cup 16. The bottom surface of the sole 8 is provided with protuberances which improve the traction of the sandal. The heel cup 16 has a pair of forwardly projecting side flaps 18, and the sidewalls 12 have upwardly extending tab portions 20. The side flaps 18 and tabs 20 are provided with sets of circular holes 22 to which the harness member is connected as will be described below.

Figure 3:
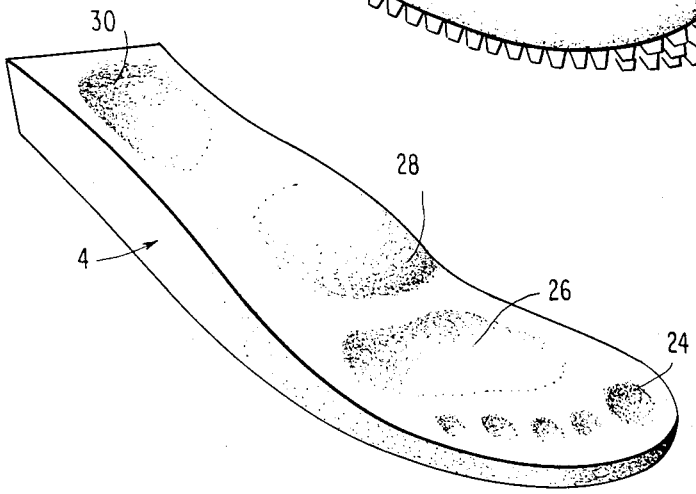
FIG. 3 is a perspective view of the foot support member utilized in the article of footwear shown in FIG. 1.
Figure 4:
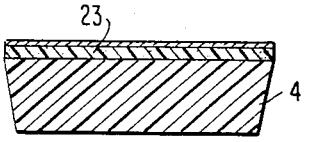
FIG. 4 is a transverse sectional view of the foot support member shown in FIG. 3.
Figure 5:
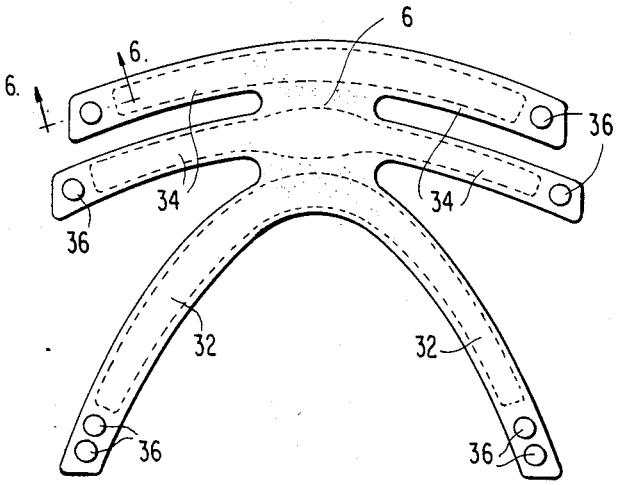
FIG. 5 is a plan view of the harness member of the invention.
Figure 7:
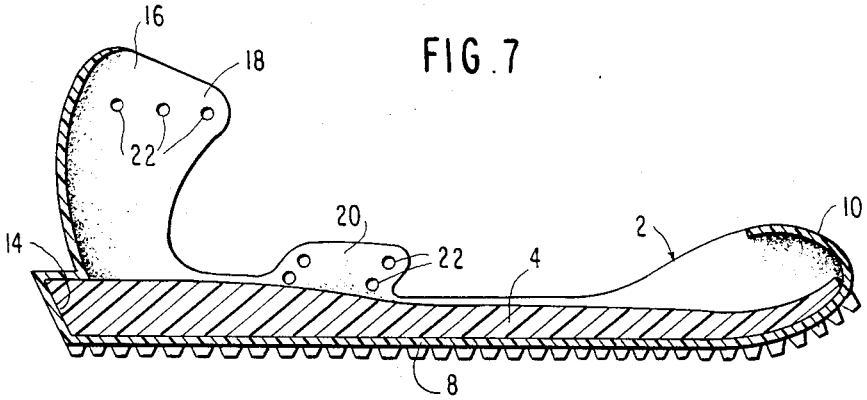
FIG. 7 is a longitudinal sectional view of the article of footwear.

The foot support member 4 is a separately molded flexible body which is placed in the body member, in overlying relation with the sole portion 8, as shown in FIGS. 1 and 7. The forward end of the foot support member is located in the toe cup,and the pocket 14 of the body member receives the rear portion of the foot support member 4. The foot support member 4 provides anatomical support for the foot and it also acts as a shock absorber to alleviate the impacts which normally occur during running. The comfort and shock absorbing features of the sandal may be enhanced by providing the member 4 with a foam cushion inlay 23 as shown in FIG. 4. This inlay may have a porous covering of textile or other material. For added comfort, extra thickness of foam cushioning material may be provided in the heel and arch areas. The upper edges of the sidewalls 12 are at about the same height as the upper surface of the foot support member. FIG. 3 shows that the upper surface of the foot support member is configured to correspond to and provide anatomical support for the wearer's foot. Preferably, this configuration includes at least one toe recess 24, a recess 26 for accommodating a ball of the wearer's foot, a raised arch support portion 28, and a recess 30 for accommodating the heel of a wearer's foot.

Figure 6:
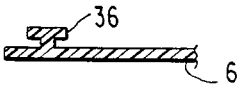
FIG. 6 is a sectional view as seen along the lines 6—6 in FIG. 5.

The flexible harness member 6 may also be formed of a molded plastic which should have a soft texture for the wearer's comfort. It has a pair of generally horizontal straps 32, and two pairs of inclined straps 34 which extend downwardly and rearwardly. These straps may be elastic and they are adjustably connectible to the body 2 by means of integrally molded buttons 36 shown in FIG. 6, provided at the ends of the straps. The diameter of these buttons is such that they may be inserted through and retained in the holes 22 on the sidewalls and heel cup of the body member. The wearer selects the holes 22 which will provide a proper fit for comfort and security. When properly adjusted, the harness member provides a comfortable means for retaining the body member 2 securely on the wearer's foot. The area from the toe cup 10 to the harness 6 is open in order to expose the foot in a sandal-like manner.

Figure 8:
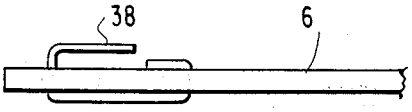
FIG. 8 is a side view of an alternative means for attaching the harness member to the body of the article of footwear.

In lieu of the buttons 36 for attaching the harness member to the body member, it is possible to use metallic hooks of the type shown at 38 in FIG. 8. This type of hook is a sheet metal piece which has a U-shaped tail portion which connects the clip to the strap, and an oppositely oriented U-shaped head portion, one leg of which is spaced from the strap and is engageable with a suitably dimensioned slit in the sidewall or heel cup of the body member.

From the foregoing, it will be appreciated that the invention provides a comfortable, moderately priced article of footwear which may be manufactured in large quantities. Persons familiar with the art will realize that the invention may take many forms other than the embodiments disclosed above. For example, the harness may include separate or separable straps which are adhered or vulcanized to the body member.

I claim:

1. An article of footwear, comprising, a flexible integrally molded body member having a sole portion, said body member being a piece of plastic material, a flexible molded foot support member mounted on the body member at a position where it overlies said sole portion, said foot support member having an upper surface which is configured to correspond to and provide anatomical support for a wearer's foot, and a flexible harness member connected to the body member and comprising means for retaining the body member on the foot of a wearer, said harness member comprising a plurality of elastic straps, said harness member being a piece of molded plastic material which is formed separately from said body member before being connected to the body member, said harness member having a soft texture for the comfort of a wearer.

2. An article of footwear according to claim 1 wherein the body member has a heel cup, said harness member having straps which are generally horizontal and straps which are inclined downwardly and rearwardly, said generally horizontal straps being connected to said heel cup.

3. An article of footwear according to claim 2 wherein said heel cup has forwardly extending side flaps, and said generally horizontal straps are connected to said side flaps.

4. An article of footwear according to claim 2 wherein the body member has upstanding sidewalls located on opposite sides of said foot support member, said inclined straps being connected to said sidewalls.

5. An article of footwear according to claim 1 wherein the upper surface of the foot support member is provided with the following: at least one toe recess, a recess for accommodating a ball of a wearer's foot, a recess for accommodating the heel of a wearer's foot, and a raised arch support portion.

6. An article of footwear according to claim 1 wherein the body member is provided with upstanding sidewalls which lie on opposite sides of said foot support member.

7. An article of footwear according to claim 1 wherein the body member has a rear portion provided with a forwardly open pocket, said foot support member having a rear portion which is retained in said pocket.

8. An article of footwear according to claim 1 wherein the body member has a forward portion provided with a toe cup integrally molded therein said article of footwear being open from the toe cup to the harness to expose the foot.

9. An article of footwear according to claim 1 wherein the body member has a forward toe cup, a rear heel cup and longitudinal sidewalls: said toe cup, heel cup and sidewalls being molded integrally with said sole portion.

10. An article of footwear according to claim 9 wherein each of the sidewalls has an upwardly extending tab portion, and the heel cup has forwardly extending side flaps, said harness member being connected to said tab portions and said side flaps.

11. An article of footwear according to claim 9 wherein said harness member has a generally horizontal strap portion connected to the heel cup, said harness member having rearwardly and downwardly inclined strap portions connected to the sidewalls.

12. An article of footwear according to claim 9 wherein the sidewalls have upper edges which are at about the same height as the upper surface of the foot support member.

13. An article of footwear, comprising, a body member, a foot support member and a harness member, said body member being a flexible integrally molded plastic member which has a sole portion, a forward portion with a toe cup, a rear portion with a forwardly open pocket and a heel cup which has forwardly extending side flaps, upstanding longitudinal sidewalls located on opposite sides of the foot support member and having upper edges which are about at the same height as the upper surface of the foot support member, each of said sidewalls having an upwardly extending tab portion, said foot support member being a flexible integrally molded member which overlies the sole portion and has an upper surface provided with a toe recess, recess means for accommodating a ball of a wearer's foot, recess means for accommodating the heel of a wearer's foot, and a raised arch support portion, said foot support member having a rear portion retained in said forwardly open pocket of the body member, said harness member being connected to the body member and being operable to retain the body member on a wearer's foot, said harness member being a piece of flexible molded elastic plastic material which has a soft texture for the comfort of a wearer, said harness member having generally horizontal straps and inclined straps which are inclined downwardly and rearwardly, said generally horizontal straps being connected to the side flaps of the heel cup, said inclined straps being connected to the tab portions of said sidewalls;

said article of footwear being open from the toe cup to the harness to expose a wearer's foot.

* * * * *